US006450484B1

(12) United States Patent
Popov

(10) Patent No.: US 6,450,484 B1
(45) Date of Patent: Sep. 17, 2002

(54) MULTIPLE-NOZZLE GAS-LIQUID EJECTOR

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/445,539

(22) PCT Filed: Mar. 15, 1999

(86) PCT No.: PCT/IB99/00415

§ 371 (c)(1),
(2), (4) Date: Dec. 8, 1999

(87) PCT Pub. No.: WO99/47817

PCT Pub. Date: Sep. 23, 1999

(30) Foreign Application Priority Data

Mar. 16, 1998 (RU) ..... 98105006

(51) Int. Cl.[7] ..... B01F 3/04
(52) U.S. Cl. ..... 261/76; 261/DIG. 75
(58) Field of Search ..... 261/76, DIG. 75; 239/338, 428.5; 417/151, 158

(56) References Cited

U.S. PATENT DOCUMENTS

| | | | | |
|---|---|---|---|---|
| 2,382,391 A | * | 8/1945 | Berman | |
| 2,582,069 A | * | 1/1952 | Rose | |
| 5,628,623 A | | 5/1997 | Skaggs | |
| 6,199,834 B1 | * | 3/2001 | Popov et al. | 261/76 |
| 6,220,578 B1 | * | 4/2001 | Popov | 261/76 |
| 6,224,042 B1 | * | 5/2001 | Popov | 261/76 |
| 6,261,067 B1 | * | 7/2001 | Popov | 417/198 |

FOREIGN PATENT DOCUMENTS

| | | | |
|---|---|---|---|
| SU | 112242 | | 12/1958 |
| SU | 1054580 | | 11/1983 |
| SU | 1291729 | | 2/1987 |
| SU | 1291730 | | 2/1987 |
| WO | WO 99/31392 | * | 6/1999 |

OTHER PUBLICATIONS

Sokolov E.Y. and Zinger N.M., "Jet apparatuses" book, 1989, USSR, Moscow, "Energoatomizdat" Publishing house, pp. 94, 95, 256, 257.

* cited by examiner

*Primary Examiner*—C. Scott Bushey
(74) *Attorney, Agent, or Firm*—Mark A. Oathout

(57) ABSTRACT

The present invention pertains to the field of jet technology and essentially relates to a multi-nozzle liquid-gas ejector having nozzles and mixing chambers placed in alignment to each of the nozzles. The distance between the outlet section of each nozzle and the inlet section of the appropriate corresponding mixing chamber is determined from the following formula:

$$L = k\sqrt[4]{\frac{2F_c^3 Pg}{F_k^2 \gamma}}$$

where L—distance between the outlet section of the nozzle and the inlet section of the corresponding mixing chambers; k—design factor ranging from 0.001 to 0.3; $F_c$ area of the minimal cross-section of the nozzle; $F_k$ area of the minimal cross-section of the mixing chamber; P—liquid pressure at the nozzle inlet; g—acceleration of gravity; γ—density of the liquid fed into the nozzle.

1 Claim, 1 Drawing Sheet

MULTIPLE-NOZZLE GAS-LIQUID EJECTOR

BACKGROUND OF THE INVENTION

The present invention pertains to the field of jet technology, primarily to liquid-gas ejectors for producing a vacuum.

An ejector is known, which comprises a steam nozzle, a mixing chamber, converging in the flow direction, with a throttle and a diffuser (see, Sokolov E. Y. & Zinger N. M., "Jet Apparatuses", Moscow, "Energoatomizdat" Publishing house, 1989, pages 94–95).

Ejectors of this type are widely adopted for evacuation of gas-vapor mediums in the condenser units of steam turbines and in steam-ejector refrigeration units.

However the efficiency of these ejectors is relatively low in cases where the evacuated gaseous medium(s) contain a lot of condensable components.

The closest analogue to the multi-nozzle liquid-gas ejector introduced in the invention is a multi-nozzle liquid-gas ejector having liquid nozzles and mixing chambers placed in alignment to each nozzle (see, Sokolov E. Y. & Zinger N. M., "Jet Apparatuses", Moscow, "Energoatomizdat" Publishing house, 1989, pages 256–257).

Such ejectors are used in power engineering as air-ejector devices of condenser units, in water deaeration vacuum systems, and for vacuumization of various reservoirs. One characteristic of the given ejectors is the fact that the steam contained in an evacuated steam-air mixture is condensed during evacuation and therefore a water-air mixture is compressed in the mixing chamber of the ejector (water is usually used as the liquid motive medium fed into the mentioned ejectors).

However the operational effectiveness of these ejectors is not high enough due to the significant influence, which is exerted on the performance of the liquid-gas ejectors by the distance between the outflow face of ejectors nozzle and the inflow face of ejector's mixing chamber.

SUMMARY OF THE INVENTION

The objective of the present invention is to increase the efficiency factor of a multi-nozzle liquid-gas ejector due to optimization of the distance between the outflow faces of the ejector nozzles and the inflow faces of the ejector mixing chambers.

The stated objective is achieved as follows: in a multi-nozzle liquid-gas ejector having nozzles and mixing chambers placed in alignment to the nozzles, the distance between the outlet section of each nozzle and the inlet section of the appropriate corresponding mixing chamber is determined from the following formula:

$$L = k\sqrt[4]{\frac{2F_c^3 Pg}{F_k^2 \gamma}}$$

where L—distance between the outlet section of the nozzle and the inlet section of the appropriate mixing chamber;

k—design factor ranging from 0.001 to 0.3;

$F_c$ area of the minimal cross-section of the nozzle;

$F_k$ area of the minimal cross-section of the mixing chamber;

P—liquid pressure at the nozzle—s inlet;

g—acceleration of gravity;

γ—density of the liquid fed into the nozzle.

Experimental research has shown, that the distance between the outflow face of the ejector nozzle and the inflow face of the mixing chamber aligned with this nozzle exerts a significant influence on the effectiveness of evacuation of a gaseous medium by the liquid-gas ejector. The value of this distance depends not only on the liquid pressure at the inlet of each nozzle, but also on the surface areas of the minimal cross-sections of the mixing chamber and the nozzle. Additionally, the range of values of the design factor of proportionality k was determined as a result of the experiments. The k factor can amount from 0.001 to 0.3.

So on the basis of the described formula it is possible to develop multi-nozzle liquid-gas ejectors with various geometries and with various pressures at the nozzles' inlets, which provide the rated performance while at the same time exhibiting an increased efficiency factor.

And what is more, it is possible to develop multi-nozzle liquid-gas ejectors comprising the nozzles with different geometrical parameters, which allows the design of ejectors of any required capacity.

Thus, a multi-nozzle liquid-gas ejector, which is designed with the use of the above mentioned formula obtained on the basis of experimental data analysis, exhibits an increased efficiency factor because it requires minimal energy consumption for the ejection of an evacuated gaseous medium.

DETAILED DESCRIPTION

Figure 1:
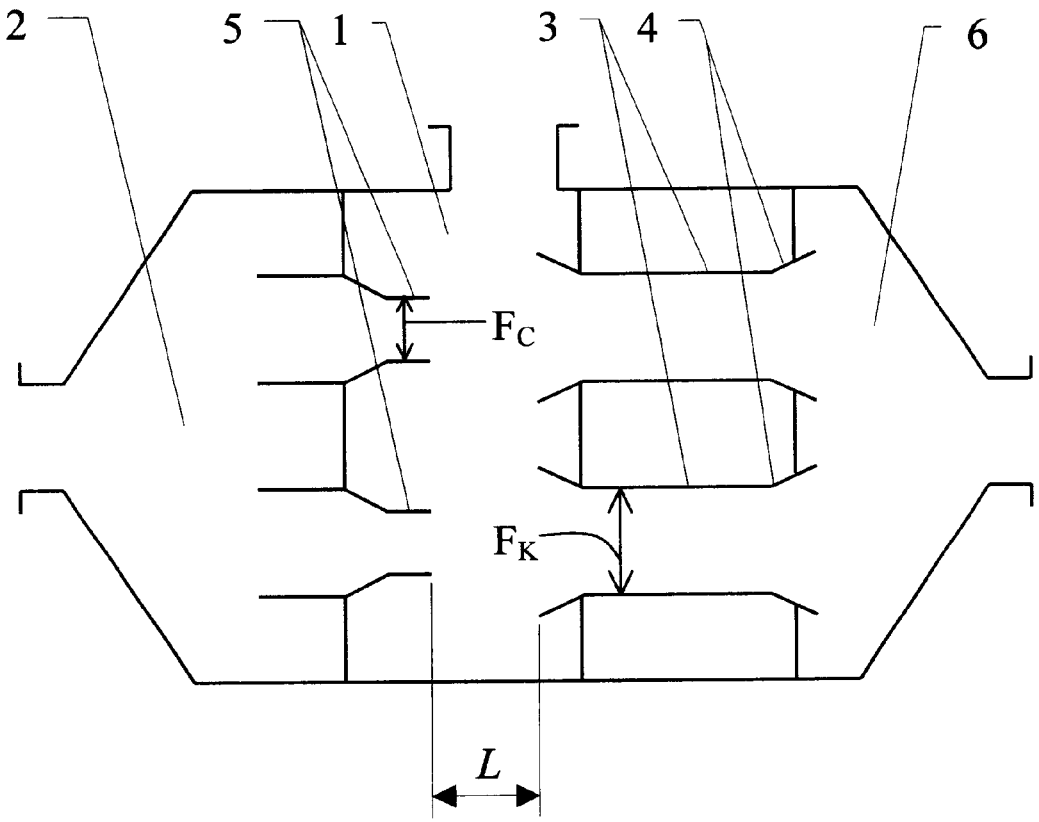
FIG. 1 represents a schematic diagram of a multi-nozzle liquid-gas ejector.

The multi-nozzle liquid-gas ejector has a receiving chamber 1, a distribution chamber 2, mixing chambers 3, diffusers 4, nozzles 5 and a discharge chamber 6. Distance (L) between the outlet section of each nozzle 5 and the inlet section of each corresponding mixing chamber 3 is determined from the following formula:

$$L = k\sqrt[4]{\frac{2F_c^3 Pg}{F_k^2 \gamma}}$$

where L—distance between the outlet section of the nozzle 5 and the inlet section of the corresponding mixing chamber 3;

k—design factor ranging from 0.001 to 0.3;

$F_c$ area of the minimal cross-section of the nozzle 5;

$F_k$area of the minimal cross-section of the mixing chamber 3;

P—liquid pressure at the inlet of the nozzle 5;

g—acceleration of gravity;

γ—density of the liquid fed into the nozzle 5.

The liquid-gas ejector operates as follows. A liquid medium under specified pressure is fed into the nozzles 5 through the distribution chamber 2. Flowing out from the nozzles 5, liquid jets entrain an evacuated gaseous medium from the receiving chamber 1 into the mixing chambers 3, where the liquid mixes with the evacuated gaseous medium and compresses it at the same time. A gas-liquid mixture from the mixing chambers 3 flows into the diffusers 4 (if they are installed) and then—into the discharge chamber 6. The mixture passes from the discharge chamber 6 to another destination, for example into a separator (not shown in the drawing), where the compressed gas is separated from the liquid. Industrial Applicability: The described ejector can be applied in chemical, petrochemical, food and other industries, where production of a vacuum by means of evacuation of gaseous or gas-vapor mediums and further compression of the evacuated gaseous medium up to a rated process pressure are required.

What is claimed is:

1. A multi-nozzle liquid-gas ejector, comprising a plurality of nozzles and a plurality of mixing chambers, that correspond to each of the nozzles, wherein the distance between the outlet section of each nozzle and the inlet section of the appropriate corresponding mixing chamber is determined from the following formula:

$$L = k\sqrt[4]{\frac{2F_c^3 Pg}{F_k^2 \gamma}}$$

where L—distance between the outlet section of the nozzle and the inlet section of the corresponding mixing chamber;

k—design factor ranging from 0.001 to 0.3;

$F_c$—area of the minimal cross-section of the nozzle;

$F_k$—area of the minimal cross-section of the mixing chamber;

P—liquid pressure at the nozzle inlet;

g—acceleration of gravity; and y—density of the liquid fed into the nozzle.

* * * * *